US012410380B2

(12) United States Patent
Choi et al.

(10) Patent No.: US 12,410,380 B2
(45) **Date of Patent: *Sep. 9, 2025**

(54) METHOD USING AN ORGANIC SOLVENT EMULSION PROCESS FOR MANUFACTURING OILGEL CAPSULES AND METHOD FOR MANUFACTURING CONTACT PARTS FOR A VEHICLE INCLUDING THE OILGEL CAPSULES

(71) Applicants: HYUNDAI MOTOR COMPANY, Seoul (KR); KIA CORPORATION, Seoul (KR); Sahmyook University Industry-Academic Cooperation Foundation, Seoul (KR)

(72) Inventors: Hu Yeon Choi, Suwon-si (KR); In Woong Lyo, Suwon-si (KR); Myoung Hwan Park, Guri-si (KR); Yu Ri Park, Seoul (KR); Geon Woo Lim, Seoul (KR); Chan Hyun Cho, Seoul (KR)

(73) Assignees: HYUNDAI MOTOR COMPANY, Seoul (KR); KIA CORPORATION, Seoul (KR); Sahmyook University Industry-Academic Cooperation Foundation, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/077,870

(22) Filed: Dec. 8, 2022

(65) Prior Publication Data

US 2023/0303946 A1 Sep. 28, 2023

(30) Foreign Application Priority Data

Mar. 25, 2022 (KR) ..... 10-2022-0037209

(51) Int. Cl.
*C10M 171/06* (2006.01)
*C10M 145/04* (2006.01)
(Continued)

(52) U.S. Cl.
CPC ..... *C10M 171/06* (2013.01); *C10M 145/04* (2013.01); *C10M 169/044* (2013.01);
(Continued)

(58) Field of Classification Search
CPC ..... C10M 171/06; C10M 145/04; C10M 169/044; C10M 2217/024; C10M 2217/044
See application file for complete search history.

(56) References Cited

U.S. PATENT DOCUMENTS 5,908,377 A * 6/1999 Fukuda ..... B01J 19/06 516/108
11,180,713 B2 11/2021 An et al.
(Continued)

FOREIGN PATENT DOCUMENTS

EP 3839021 A1 6/2021
JP 2014122282 A 7/2014
(Continued)

OTHER PUBLICATIONS

M. Fahad et al., Thermal gelation of Pluronic F-127 in ethylene glycol as non-aqueous solvent, Plastics, Rubber and Composites 2012 vol. 41 No. 3, Apr. 2, 2011, 10pp., 10.1179/1743289811Y.0000000027.

(Continued)

*Primary Examiner* — Vishal V Vasisth
(74) *Attorney, Agent, or Firm* — Lempia Summerfield Katz LLC

(57) ABSTRACT

Disclosed are an emulsion composition including oilgel capsules, a coating composition including the emulsion
(Continued)

composition, and a method for preparing the same, as well as a method for coating a machine part with the coating composition. In particular, the compositions and machine parts have excellent wear resistance and increased production compared to an existing process of providing oilgel capsules as an overlay layer by mixing an organic solvent and a nonionic surfactant with an oilgel.

17 Claims, 5 Drawing Sheets

(51) Int. Cl.
*C10M 169/04* (2006.01)
*C10N 20/06* (2006.01)
*C10N 50/10* (2006.01)

(52) U.S. Cl.
CPC . *C10M 2217/024* (2013.01); *C10M 2217/044* (2013.01); *C10N 2020/06* (2013.01); *C10N 2050/10* (2013.01)

(56) References Cited

U.S. PATENT DOCUMENTS

2015/0315509 A1 11/2015 Watanabe et al.
2019/0185782 A1 6/2019 Webster et al.
2021/0179964 A1 6/2021 An et al.
2021/0179966 A1 6/2021 An et al.

FOREIGN PATENT DOCUMENTS

JP 6702763 B2 5/2020
KR 20210077109 A 6/2021
KR 20210077110 A 6/2021

OTHER PUBLICATIONS

Michael A. Rogers et al., Temperature Dependence of Relaxation Spectra for Self-Assembled Fibrillar Networks of 12-Hydroxystearic Acid in Canola Oil Organogels, Food Biophysics (2012) 7:132-137, Apr. 17, 2012, 6pp., 10.1007, s11483-012-9250-7.
Plamen Kirilov et al., A new type of colloidal dispersions based on nanoparticles of gelled oil, Colloids and Surfaces A: Physicochem. Eng. Aspects 328 (2008) 1-7, Jun. 13, 2008, 7pp., 10.1016/j.colsurfa.2008.06.011.
V. Ajay Mallia et al., Oscillatory Rheology and Surface Water Wave Effects on Crude Oil and Corn Oil Gels with (R)-12-Hydroxystearic Acid as Gelator, Ind. Eng. Chem. Res., Jan. 10, 2016, 7pp., 10.1021/acs.iecr.5b04267.

* cited by examiner

No capsule: Coating solution without oilgel capsules
New method: Coating solution using the present disclosure
Old method: Coating solution using the prior patent

METHOD USING AN ORGANIC SOLVENT EMULSION PROCESS FOR MANUFACTURING OILGEL CAPSULES AND METHOD FOR MANUFACTURING CONTACT PARTS FOR A VEHICLE INCLUDING THE OILGEL CAPSULES

CROSS-REFERENCE TO RELATED APPLICATION

This application claims under 35 U.S.C. § 119(a) the benefit of and priority to Korean Patent Application No. 10-2022-0037209 filed on Mar. 25, 2022, the entire contents of which are incorporated herein by reference.

BACKGROUND

(a) Technical Field

The present disclosure relates to an emulsion composition including oilgel capsules and a method for preparing the emulsion composition, a coating composition including the emulsion composition and a method for preparing the coating composition, and a method for coating a machine part with the coating composition.

(b) Background Art

A bearing is one of the mechanical elements that limits the relative motion with respect to a desired motion and reduces friction between moving parts. Bearings are prone to fatigue failure under load with hard chains or beads so that they have excellent wear resistance, corrosion resistance, and thermal conductivity. Alloy-based bearings with vibration-absorbing function (hereinafter referred to as bearing alloys) may be used. However, bearing alloys also inevitably suffer wear due to continuous friction, which may lead to a rapid deterioration in seizure resistance. Accordingly, various coating materials, (e.g., overlay materials), have been developed to protect the bearing alloys from wear. Polyamideimide and lubricants may be used as the overlay materials.

When developing overlay materials, it is necessary to consider that the wear resistance of bearings deteriorates significantly at the beginning of vehicle operation, and it has been necessary to extend the lifespan of composite materials (bearing alloys and overlay materials) by preventing additional wear at the initial stage of vehicle operation, i.e., the initial wear stage of the bearings. Therefore, there has been a need to develop overlay materials capable of maintaining the seizure resistance even after wear occurs in the composite materials.

Accordingly, in order to produce an overlay material, one example within the prior art (Korean Patent Application KR 10-2021-0077110 A) requires forming oilgel capsules in an aqueous solution through an oil in water (0/W) emulsion method, then making it into a powder formulation through freeze-drying and redispersing the oil powder in an organic solvent. The prior art further discloses preparing an organic solution containing the oil capsules by forming oilgel capsules by an O/W emulsion method and redispersing it in an organic solvent.

However, not only a long drying time for producing such a powder is required, but also the process of redispersing the powder in an organic solvent after producing the powder causes problems in mass production or has a problem of lowering efficiency.

Further, due to the O/W emulsion method, the oilgel capsules of the prior patent have problems in that there is a difficulty in redispersing the oilgel capsules in the organic solvent because the hydrophilic group exists outside the oilgel capsules, and the productivity is lowered accordingly.

Therefore, there is a need for a new manufacturing method of oilgel capsules, which is for manufacturing an overlay material that solves the above problems.

SUMMARY OF THE DISCLOSURE

One aspect of the present disclosure is to provide new oilgel capsules using an organic solvent emulsion method and a method for manufacturing the same in order to fundamentally solve the problems as described above.

In order to solve the problems as described above, the following solutions of the present disclosure are provided.

One aspect of the present disclosure provides a method for preparing an emulsion composition including oilgel capsules. The method includes: mixing oil and a gelator to prepare an oilgel; and mixing the oilgel and an organic solvent containing a nonionic surfactant to produce at least one oilgel capsule.

In one embodiment, the nonionic surfactant is a block copolymer having a hydrophilic portion and a hydrophobic portion together.

In one embodiment, the nonionic surfactant includes poly(ethylene oxide)-poly(propylene oxide)-poly(ethylene oxide) (PEO-PPO-PEO) (Pluronic) derivatives, poly(propylene oxide)-poly(ethylene oxide)-poly(propylene oxide) (PPO-PEO-PPO) (Pluronic R) derivatives, poly(ethylene oxide)-poly(butylene oxide)-poly(ethylene oxide) (PEO-PBO-PEO) derivatives, or tetronic acid derivatives in the form of poly(alkylene-oxide) block copolymers, polyoxyethylene lauryl ether (e.g., Brij), polyoxyethylene trimethylnonyl ether (e.g., Tergitol), polyoxyethylene alkyl ether, polyoxyethylene fatty acid ester, polyoxyethylene alkylphenol ether (e.g., Triton), or polyoxyethylene sorbitan fatty acid ester (e.g., Tween) in the form of alkyl PEO, sorbitan fatty acid ester (e.g., Span) in the form of fatty acid ester, or sucrose fatty acid ester.

In one embodiment, a method is provided for preparing an emulsion composition including oilgel capsules in which the organic solvent is not emulsified with the oil.

In one embodiment, the organic solvent includes at least one selected from dimethylacetamide, N-methyl-2-pyrrolidone, N-octyl pyrrolidone, N-phenyl pyrrolidone, dimethylformamide, dimethyl sulfoxide, methanol, ethanol, propanol, butanol, isopropanol, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, and derivatives thereof.

In one embodiment, the oilgel and the organic solvent containing the nonionic surfactant are mixed at a weight ratio of 1:0.5 to 1:10.

In one embodiment, the gelator is mixed in an amount of 1 to 10 parts by weight with respect to 100 parts by weight of the oil.

In one embodiment, the oil is an engine oil, and the gelator is 12-hydroxyoctadecanoic acid, ricinoleic acid, and 1,3;2,4-dibenzylidene-D-sorbitol in the form of hydroxy fatty acids, N-dioctanoyl-l-lysine, N-didecanoyl-l-lysine, N-dilauroyl-l-lysine, N-dimyristoyl-l-lysine, 2-palmitamide hexanoic acid, and N-lauroyl-L-glutamic acid-α,γ-bis(n-butylamide) in the form of amino acids, or a mixture of ceramide and lecithin.

In one embodiment, the oilgel in the mixing process with the organic solvent is in a liquid state.

In one embodiment, the oilgel capsules have a particle size of 0.1 μm or more and less than 10 μm.

In one embodiment, the oil and the gelator are mixed using a grinder, e.g., an ultrasonicator.

In one embodiment, the oilgel and the organic solvent containing the nonionic surfactant are mixed using an ultrasonicator.

In one embodiment, the oilgel has a phase transition temperature of 50° C. to 80° C.

Another aspect of the present disclosure provides an emulsion composition including oilgel capsules manufactured according to any one of the manufacturing methods of the one aspects of the present disclosure.

Another aspect of the present disclosure provides a method for preparing a coating composition for preventing wear of machine parts. The method includes: preparing an emulsion composition including oilgel capsules manufactured according to any one of the manufacturing methods disclosed herein; and preparing a coating composition by mixing the emulsion composition, a polymer, and additives.

In another embodiment, the emulsion composition is contained in an amount of 5 to 25% by weight based on the total weight of the coating composition.

In another embodiment, the coating composition is prepared while maintaining a temperature of 45° C. or less in the process of preparing the coating composition.

In another embodiment, the polymer is polyamide-imide (PAI), polyimide, polybenzimidazole, polyepoxy, polyurethane, polyethylene oxide, or polyacetal, and the additive is carbon black, polytetrafluoroethylene (PTFE), molybdenum disulfide ($MoS_2$), or polyetheretherketone (PEEK).

In another embodiment, the coating composition has a friction coefficient of 0.15 or less.

Another aspect of the present disclosure provides a method for coating a machine part requiring wear protection. The method includes coating a machine part requiring wear protection with the coating composition prepared according to another aspect of the present disclosure; and performing a drying.

In another embodiment, the coating is a bar coating, a spin coating, or a spray coating, and the drying includes performing a soft drying at a temperature in a range of 150 to 200° C. for 10 to 50 minutes and then performing a hard drying at a temperature in a range of 200 to 280° C. for 5 to 30 minutes.

In another embodiment, the machine part is a bearing of an automobile.

According to the method for manufacturing oilgel capsules according to one aspect of the present disclosure, there are effects in that the process is simplified and mass production is possible by preparing the powder using an emulsion method using an organic solvent instead of preparing a powder using an O/W emulsion (oil in water emulsion) method and freeze-drying in order to manufacture oilgel capsules.

According to the method for manufacturing oilgel capsules according to one aspect of the present disclosure, the daily production of the oilgel capsules is 100 kg or more, whereas the prior patent KR 10-2021-0077110 A has a daily production of 0.143 kg, which may give about 700 times improved productivity. Further, the prior patent takes 70 days to manufacture 10 kg of oilgel capsules, whereas the present disclosure takes 0.1 days, enabling productivity improvement.

According to the method for manufacturing oilgel capsules according to one aspect of the present disclosure, there may be provided an overlay coating material which makes oilgel capsules and exhibits excellent low friction/high durability by using a nonionic surfactant.

According to the method for manufacturing oilgel capsules according to one aspect of the present disclosure, the coating material without the oilgel capsules did not succeed in the friction coefficient evaluation, and the present disclosure (manufacturing of oilgel capsules using an organic solvent emulsion) proved that it has a similar coefficient of friction compared to the prior patent KR 10-2021-0077110 A (manufacturing of oilgel capsules using O/W emulsion) and is an excellent low-friction material. Accordingly, the present disclosure provides a novel manufacturing method for mass production of oilgel capsules and for manufacturing excellent low-friction overlay coating materials.

BRIEF DESCRIPTION OF THE DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way.

DETAILED DESCRIPTION

In the present specification, "comprising" means that other components may be further included unless otherwise specified.

In the present specification, when a range is described for a variable, the variable includes all values within the described range including the stated endpoints of the range. For example, a range of "5 to 10" not only includes the values of 5, 6, 7, 8, 9, and 10 as well as any subranges such as 6 to 10, 7 to 10, 6 to 9, 7 to 9, etc., but also includes any value between integers, that are appropriate for the scope of the described range, such as 5.5, 6.5, 7.5, 5.5 to 8.5, 6.5 to 9, and the like. Further, for example, a range of "10% to 30%" not only includes all integers including values such as 10%, 11%, 12%, 13%, and up to 30% as well as any subrange such as 10% to 15%, 12% to 18%, 20% to 30%, etc., but also include any value between integers, that are reasonable within the scope of the described range, such as 10.5%, 15.5%, 25.5%, and the like.

The present disclosure relates to manufacturing oilgel capsules and adding them to the overlay layer of a vehicle contact part. The present disclosure may provide a method for manufacturing oilgel capsules and a method for manufacturing a vehicle contact part including the oilgel capsules. The oilgel in the oilgel capsules provided in the present disclosure may respond to the temperature environment of the vehicle contact part, and even after oil is released, an aggregation phenomenon between gelators or an aggregation phenomenon between surfactants may not occur. Accordingly, the present disclosure can improve the low friction properties and seizure resistance of the vehicle contact part without side effects due to the aforementioned agglomeration phenomenon by adding the oilgel capsules to the overlay layer.

Methods used to manufacture micro-sized capsules are divided into chemical, physicochemical, and mechanical techniques, and the simple and easy-to-use one among them is proceeded by the emulsion method.

Figure 1:
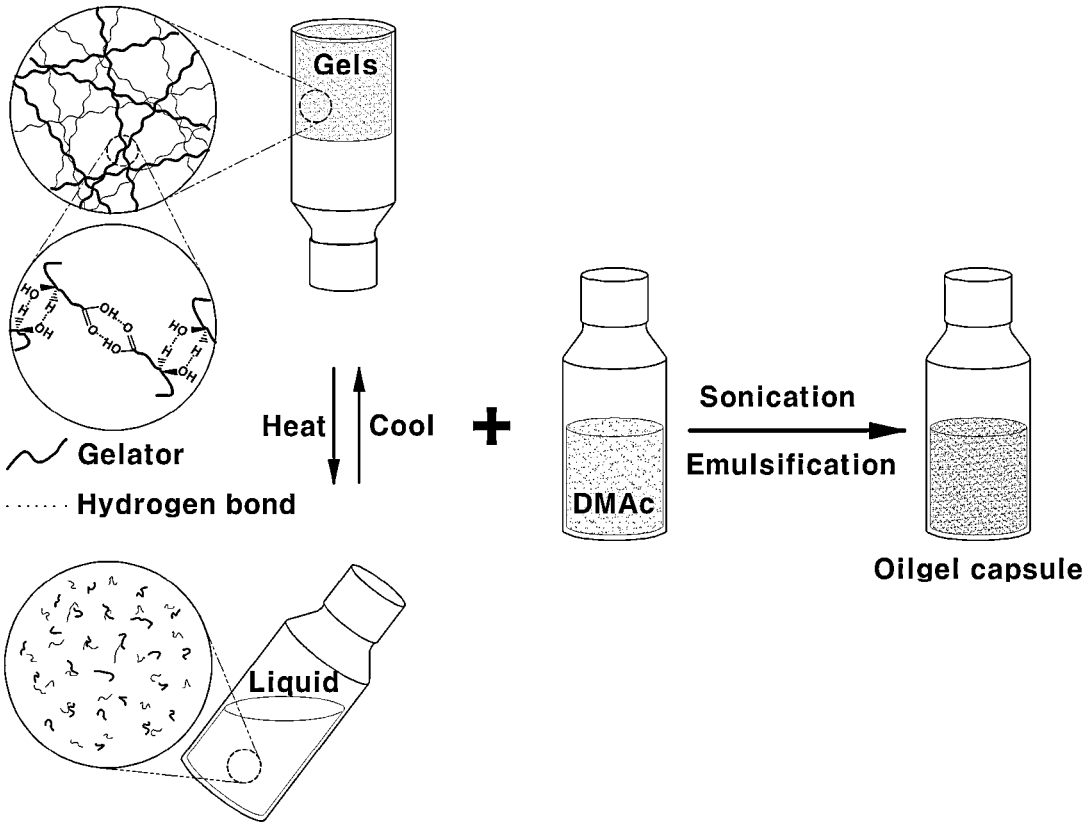
FIG. 1 is a schematic diagram of an example of a method for manufacturing oilgel capsules.

The emulsion is a system in which the physical properties and oil properties of incompatibility are dispersed and spread in a colloidal state through a surfactant, and the emulsion is being studied and applied in various fields such as food, beverage, cosmetics, and organic/inorganic polymer synthesis. The type of emulsion may be divided into O/W (oil in water), W/O (water in oil), multiple emulsions, and the like. The most frequently used emulsion method is O/W emulsion, and it is safely prepared up to a dispersion phase concentration of 69%. Oilgel capsules dispersed in an organic solvent should be manufactured for use as an automotive contact part overlay, but O/W emulsion is prepared under an aqueous solution so that a drying method for redispersing the oilgel capsules in the organic solvent is required. A schematic diagram of a method for manufacturing oilgel capsules is as shown in FIG. 1.

Therefore, the O/W emulsion method is difficult because it takes two more processes for mass production. As such, the need for a method for manufacturing oilgel capsules, the method capable of efficiently mass-producing the oilgel capsules, is increasing, and the present disclosure intends to provide a method capable of efficiently solving the problems as described above.

The present disclosure relates to a method for manufacturing oilgel capsules by an organic solvent emulsion method for efficiently mass-producing oilgel capsules. More specifically, the emulsion method under an organic solvent, unlike the emulsion method under an aqueous solution (O/W emulsion), eliminates the two manufacturing processes of drying and redispersion, thereby shortening the process time and enabling mass production.

Specifically, an engine oil and a gelator (12-HSA) form a gel that responds to temperature and can protect the oilgel, and when pluronic F-127 as a nonionic surfactant and DMAc as an oil-immiscible organic solvent are mixed, oilgel capsules are formed. The oilgel capsules thus manufactured respond to temperature.

KR 10-2021-0077110 A requires an additional process of forming oilgel capsules in an aqueous solution through an O/W emulsion method, then making them into an oil powder formulation through freeze-drying, and redispersing the oil powder in an organic solvent. However, these two manufacturing processes (powder preparation and redispersion) cause problems in efficient mass production of oilgel capsules or reduce efficiency.

Figure 2:
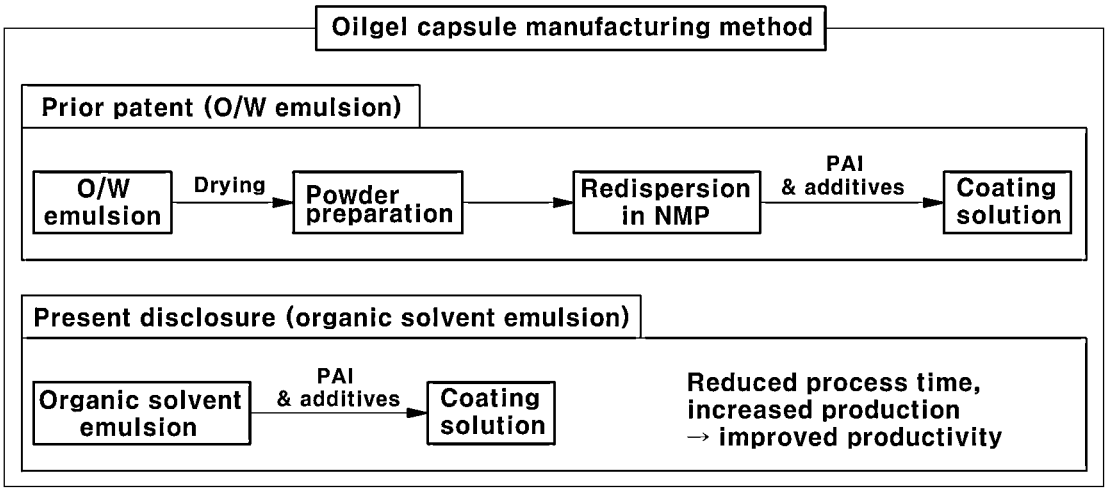
FIG. 2 is a schematic diagram comparing the methods for manufacturing oilgel capsules of the prior patent and the present disclosure.

Accordingly, the present disclosure provides a method for manufacturing oilgel capsules having a micro size and responding to temperature by using an organic solvent emulsion method rather than an O/W emulsion method. A schematic diagram comparing the oilgel capsule manufacturing methods of the prior patent and the present disclosure is as shown in FIG. 2.

Figure 3:
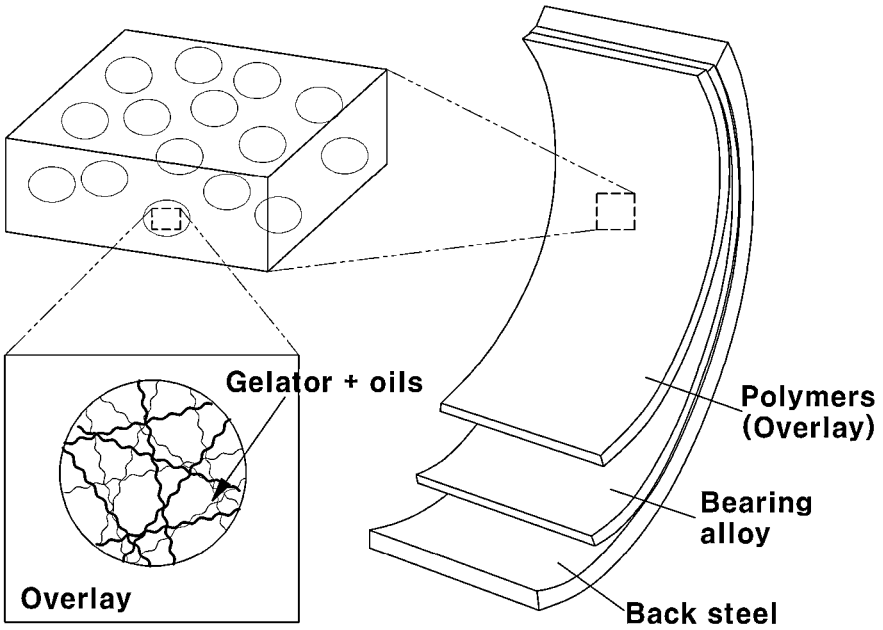
FIG. 3 is a schematic diagram of an example of an overlay layer applied to an automotive contact part (bearing) to enable additional wear to be prevented in the initial wear stage of the parts.

In addition, the overlay composite material in which the oilgel capsules manufactured in this way, a polyamide-imide (PAI) polymer, and additives are mixed may be applied to a contact part (bearing) of an automobile through a coating method, soft drying, and hard drying, and this overlay layer is liquefied and released by the elevated temperature, preventing additional wear during the initial wear stage of the part. (See FIG. 3)

Further, the present disclosure provides manufacturing a large amount of oilgel capsules responding to temperature through an organic solvent emulsion, mixing the oilgel capsules with the overlay composite material for the development of an effective overlay composite material, and then introducing an oilgel capsule coating layer to an automotive contact part.

The process for preparing an oilgel capsule organic solvent emulsion is described as follows.

In one embodiment, 0.175 g of 12-hydroxyoctadecanoic acid (12-HSA) as a gelator (2.5% by weight) is added to 7 g of an engine oil and mixed using an ultrasonicator. The oilgel thus prepared has a transition temperature of liquefaction and gelation between 50° C. and 80° C. depending on the content of the gelator (1 to 5% by weight). This means that the oilgel maintains a gel state at a low temperature lower than 50° C., but when the temperature is increased to the transition temperature or higher, it is gradually changed from the gel state to the inherent liquid state of oil to have fluidity.

13 ml of a dimethylacetamide (DMAc or DMA) solution (2.5 to 5% by weight) containing pluronic F-127 as a nonionic surfactant is added to 7 g of the solution (oil containing 2.5% by weight of 12-HSA) prepared as described above, and then mixed using an ultrasonicator. When mixed in this way, it can be confirmed that the transparent solution changes to an opaque state and becomes an emulsion state, which means that the oilgel capsule particles are formed in the solution. (At this time, oil containing 12-HAS and the DMAc solution containing pluronic F-127 may have a ratio of 1:1 to 1:10. Further, the size of the oilgel capsule particles may be adjusted depending on the ultrasonicator's amplitude and irradiation time, and the applied container, and if they are manufactured by applying appropriate conditions, oilgel capsule particles of 0.1 to 10 μm may be uniformly obtained.)

Figure 4A:
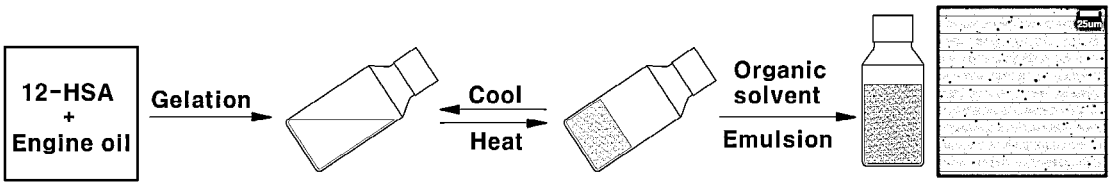
FIGS. 4A and 4B are views of an example of an oilgel prepared according to the preparation process of an oilgel capsule organic solvent emulsion, and an organic solvent emulsion including the same.
Figure 4B:
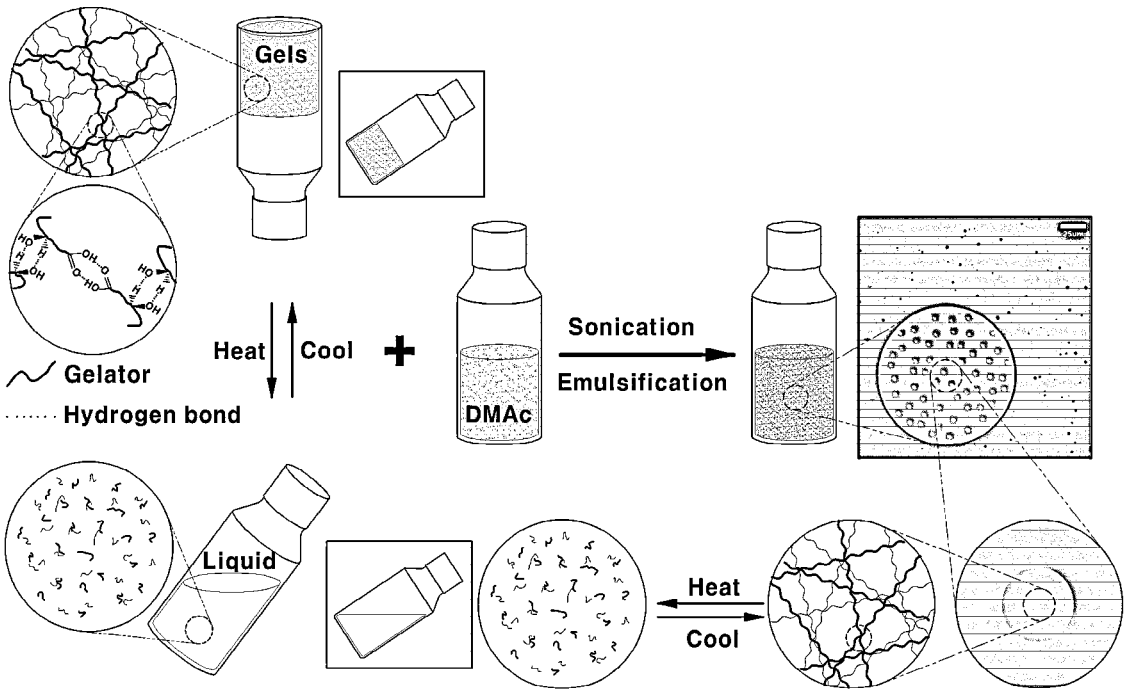

The emulsion in which the oilgel and oilgel capsule particles are formed according to the preparation method is as shown in FIG. 4. In order to form a visual image, Nile Red, a fluorescent dye, is mixed with an organic solvent, and red shows the organic solvent and black shows the oilgel capsules.

The manufacturing process of the overlay solution and film containing the prepared oilgel emulsion is as follows.

In one embodiment, an overlay capsule mixed solution is prepared by mixing 10 g of the prepared 35% by weight oilgel capsule emulsion and 90 g of an overlay solution (a DMAc solution in which PAI and additives are dissolved in an amount of about 35% by weight). In the embodiment, a temperature of less than 45° C. is maintained during the mixing.

The prepared overlay capsule mixed solution is coated on the surface of a bearing through various coating methods, (e.g., bar coating, spin coating, spray coating, etc.), soft drying (e.g., at a temperature in a range of 150 to 200° C. for 30 minutes) is first applied, and then hard drying (e.g., at a temperature in a range of 210 to 240° C. for 15 minutes) is applied to complete a coating layer with a thickness of about 10 to 50 μm.

In one embodiment, a method for preparing an emulsion composition including oilgel capsules includes: mixing an oil and a gelator to prepare an oilgel; and mixing the oilgel and an organic solvent containing a nonionic surfactant to produce at least one oilgel capsule.

In one example, in the mixing of the oil and the gelator, the gelator may be added to oil. However, because the addition target and the addition direction need not be specified as described above, oil may also be added to the gelator. For more uniform mixing, the oil and the gelator may be mixed using an ultrasonicator. The formed oilgel may be in a gel state.

When the oil and the gelator are mixed, the weight ratio of the gelator (the weight of the gelator with respect to the total weight of oil) may be an effective weight ratio for gelling the entire oil to be mixed. Further, because the phase transition temperature of the oilgel changes depending on the weight ratio of the gelator, the weight ratio of the gelator may be an effective weight ratio for maintaining the gel state of the oilgel at room temperature, and it may be an effective weight ratio for maintaining the gel state even in all temperature environments (e.g., up to about 60° C.) that a bearing containing an oilgel may experience before it is mounted on a vehicle.

The phase transition temperature of the oilgel refers to a temperature at which an oilgel in a gel state is liquefied into a liquid state, or an oilgel in a liquid state is gelated into an oilgel in a gel state. The oilgel may maintain a gel state at a temperature less than the phase transition temperature and may maintain a liquid state at a temperature exceeding the phase transition temperature.

According to an embodiment of the present disclosure, oil may be an engine oil, and the gelator may be 12-hydroxyoctadecanoic acid (hereinafter, 12-HSA). The weight ratio of 12-HSA may be in a range of 1 to 10% by weight based on the total weight of the engine oil, and the oilgel may have a phase transition temperature in a range of 60° C. to 70° C. When less than 1% by weight of 12-HSA is mixed with an engine oil, a reticular fiber structure of 12-HSA may not be formed in the engine oil, and accordingly, an oilgel may not be formed. When more than 10% by weight of 12-HSA is mixed with an engine oil, it may reach a saturation state in which the increase in the phase transition temperature of the oilgel decreases with the increase in the weight ratio of 12-HAS. Also, because the weight of the engine oil relative to the gelator weight is relatively decreased, the lubricating properties of the oilgel or oilgel capsules may be deteriorated. Accordingly, 12-HSA may be added in an amount in a range of 1 to 10% by weight based on the total weight of the engine oil. However, the type of the gelator and the weight ratio of the gelator are not limited thereto.

In one embodiment, the nonionic surfactant is a block copolymer having a hydrophilic portion and a hydrophobic portion together.

In one embodiment, the nonionic surfactant is PEO-PPO-PEO (Pluronic) derivatives, PPO-PEO-PPO (Pluronic R) derivatives, PEO-PBO-PEO derivatives, or tetronic acid derivatives in the form of poly(alkylene-oxide) block copolymers, polyoxyethylene lauryl ether (e.g., Brij), polyoxyethylene trimethylnonyl ether (e.g., Tergitol), polyoxyethylene alkyl ether, polyoxyethylene fatty acid ester, polyoxyethylene alkylphenol ether (e.g., Triton), or polyoxyethylene sorbitan fatty acid ester (e.g., Tween) in the form of alkyl PEO, sorbitan fatty acid ester (e.g., Span) in the form of fatty acid ester, or sucrose fatty acid ester.

In one embodiment, in the preparing an emulsion composition, the organic solvent is not emulsified with the oil.

In one embodiment, the organic solvent includes dimethylacetamide, N-methyl-2-pyrrolidone, N-octyl pyrrolidone, N-phenyl pyrrolidone, dimethylformamide, dimethyl sulfoxide, methanol, ethanol, propanol, butanol, isopropanol, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, derivatives thereof, or combinations thereof.

In one embodiment, the oilgel and the organic solvent containing the nonionic surfactant are mixed at a weight ratio of 1:0.5 to 1:10. When the above numerical range is satisfied, aggregation occurs well, and the surfactant does not form self-assembled micelles so that the composition has excellent wear resistance.

In one embodiment, the gelator is mixed in an amount of 1 to 10 parts by weight with respect to 100 parts by weight of the oil.

In one embodiment, the oil is an engine oil, and the gelator is 12-hydroxyoctadecanoic acid, ricinoleic acid, and 1,3; 2,4-dibenzylidene-D-sorbitol in the form of hydroxy fatty acids, N-dioctanoyl-l-lysine, N-didecanoyl-l-lysine, N-dilauroyl-l-lysine, N-dimyristoyl-l-lysine, 2-palmitamide hexanoic acid, and N-lauroyl-L-glutamic acid-α,γ-bis(n-butylamide) in the form of amino acids, or a mixture of ceramide and lecithin.

In one embodiment, the oilgel is the mixing with the organic solvent is in a liquid state.

In one embodiment, the oilgel capsules have a particle size of 0.1 μm or more and less than 10 μm.

In one embodiment, the oil and the gelator are mixed using an ultrasonicator.

In one embodiment, the oilgel and the organic solvent containing the nonionic surfactant are mixed using an ultrasonicator.

In one embodiment, the oilgel has a phase transition temperature of 50° C. to 80° C.

Other aspect of the present disclosure provides an emulsion composition including oilgel capsules manufactured according to any one of the manufacturing methods of the one aspects of the present disclosure.

Another aspect of the present disclosure provides a method for preparing a coating composition for preventing wear of machine parts. The method includes preparing an emulsion composition including oilgel capsules manufactured according to any one of the manufacturing methods of the one aspects of the present disclosure; and preparing a coating composition by mixing the emulsion composition, a polymer, and additives.

In one embodiment, the emulsion composition is contained in an amount of 5 to 25% by weight based on the total weight of the coating composition.

In another embodiment, the coating composition is prepared while maintaining a temperature of 45° C. or less in the preparing of the coating composition.

In another embodiment, the polymer is polyamide-imide (PAI), polyimide, polybenzimidazole, polyepoxy, polyurethane, polyethylene oxide, or polyacetal, and the additive is carbon black, polytetrafluoroethylene (PTFE), molybdenum disulfide ($MoS_2$), or polyetheretherketone (PEEK).

In another embodiment, the coating composition has a friction coefficient of 0.15 or less.

Another aspect of the present disclosure provides a method for coating a machine part requiring wear protection.

The method includes: coating a machine part requiring wear protection with the coating composition prepared according to another aspect of the present disclosure; and performing drying.

In one embodiment, the coating process is bar coating, spin coating, or spray coating, and the drying process includes performing soft drying at a temperature in a range of 150 to 200° C. for 10 to 50 minutes and then performing hard drying at a temperature in a range of 200 to 280° C. for 5 to 30 minutes.

In another embodiment, the machine part is a bearing of an automobile.

Hereinafter, the present disclosure is described in more detail through the following Preparation Examples, Examples, and Experimental Examples. However, these Preparation Examples, Examples, and Experimental Examples are for illustrating the present disclosure, and the scope of the present disclosure is not limited thereto.

Example 1. Preparation of an Overlay Solution Containing Oilgel Capsules Using a Method for Preparing an Organic Solvent Emulsion (1) Preparation of an Oilgel Capsule Emulsion Solution An oilgel is prepared by adding 0.175 g of 12-hydroxyoctadecanoic acid (12-has) as a gelator to 7 g of an engine oil and mixing them using an ultrasonicator. The oilgel (a gelator content of 2.5% by weight) has a transition temperature of liquefaction and gelation at about 63° C.

13 ml of a dimethylacetamide (DMAc) solution (5% by weight) containing 0.65 g of pluronic F-127 as a nonionic surfactant was added to 7 g of the solution (oil containing 2.5% by weight of 12-HSA) prepared as described above, and then mixed using an ultrasonicator to prepare an emulsion solution which was changed to an opaque state. During mixing, the application amplitude of the ultrasonicator was 80%, the irradiation time was 2 minutes, and as a result of confirming with a confocal microscope, oilgel capsule particles of less than 2 μm could be uniformly obtained. The preparation process was as shown in FIG. 4.

(2) Preparation of an Overlay Solution Containing an Oilgel Capsule Emulsion

An overlay solution (solid content of 35% by weight) was prepared by mixing polyamide-imide (PAI) and the additives MoS2, graphite, and PTFE with a DMAc solution.

90 g of the overlay solution and 10 g of the 35% by weight oilgel capsule emulsion prepared in (1) were mixed at a temperature of less than 45° C. to prepare an overlay capsule mixed solution.

(3) Preparation of a Bearing Coating Layer

The overlay capsule mixed solution prepared in (2) was coated on the bearing surface through spray coating.

Figure 5:
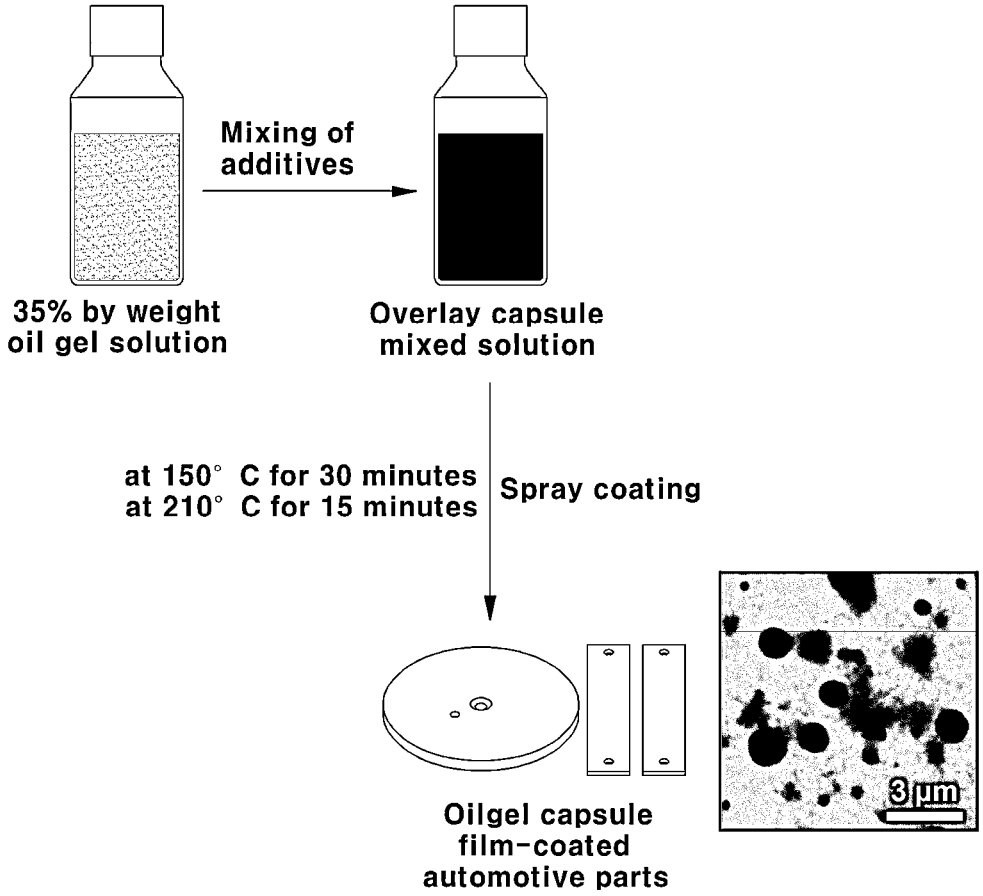
FIG. 5 is a description of an example of an oilgel capsule overlay solution and a film manufacturing process.

Thereafter, soft drying was first applied at 150° C. for 30 minutes, and then hard drying was applied at 210° C. for 15 minutes to complete a coating layer with a thickness of about 20 μm. The preparation process was as shown in FIG. 5.

Figure 6:
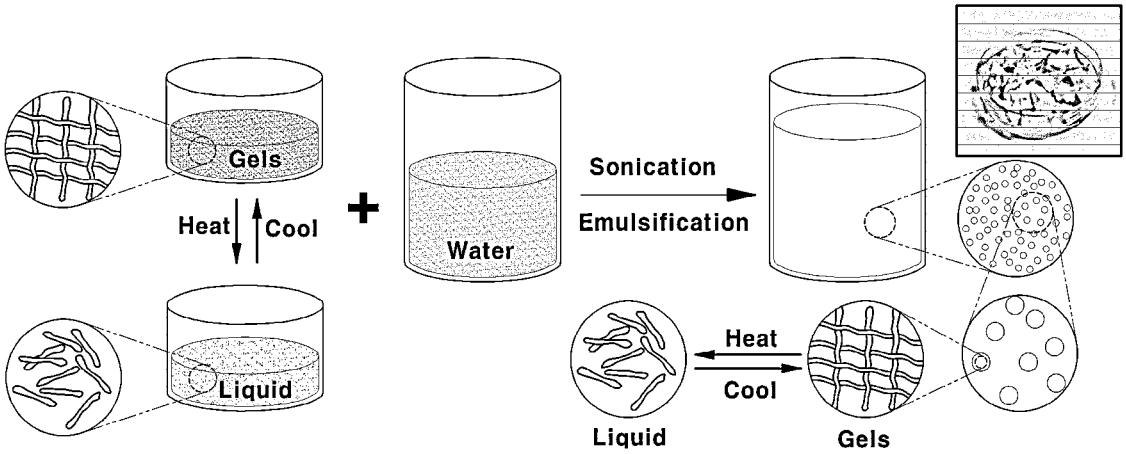
FIG. 6 is a schematic diagram of a manufacturing process of Comparative Example 1.

Comparative Example 1. Preparation of an Overlay Solution Prepared by the Conventional Meth (1) Manufacturing of Oilgel Capsules 0.3030 g of 12-HSA (about 2% by weight) as a gelator was added to 15 g of an engine oil, and then they were mixed using an ultrasonicator to prepare an oilgel having a phase transition temperature of about 62° C. After liquefying 5 g of the oilgel and adding 75 ml of a 2% by weight PVA aqueous solution thereto, they were mixed using an ultrasonicator to manufacture oilgel capsules. An oil powder was recovered by removing water from an aqueous solution containing the oilgel capsules using a freeze dryer. The manufacturing process was as shown in FIG. 6.

(2) Preparation of an Overlay Layer 10 g of the oil powder was added to 90 g of an NMP solvent to prepare an NMP solution (a first organic solution) containing 10% by weight of oilgel capsules. When preparing the first organic solution, the oilgel capsules were uniformly redispersed in the NMP solvent using a stirrer. After preparing an NMP solution (a second organic solution) containing 50% by weight of polyamideimide and additives (including a lubricant), 50 g of the first organic solution and 50 g of the second organic solution were mixed to prepare an overlay mixed solution. The overlay mixed solution was coated on the surface of a bearing alloy, dried at 150 to 200° C. for 30 minutes, and then dried at 210 to 240° C. for 15 minutes to prepare an overlay layer with a thickness of about 10 μm.

Comparative Example 2. Preparation of a Coating Solution without Oilgel Capsules An overlay solution (solid content of 35% by weight) was prepared by mixing polyamide-imide (PAI) and the additives $MoS_2$, graphite, and PTFE with a DMAc solution.

The prepared overlay solution was coated on the bearing surface through spray coating in the same manner.

Thereafter, soft drying was first applied at 150° C. for 30 minutes, and then hard drying was applied at 210° C. for 15 minutes to complete a coating layer with a thickness of about 20 μm.

Experimental Example 1. Evaluation of Low Friction and High Durability

Friction coefficient evaluation was performed on the prepared Example 1 and Comparative Examples 1 and 2.

The friction coefficients were measured by conducting the Stribeck Test in the Ball-on-Disk Friction Test mode of the CETR UMT Multi-Specimen Test System device.

Figure 7:
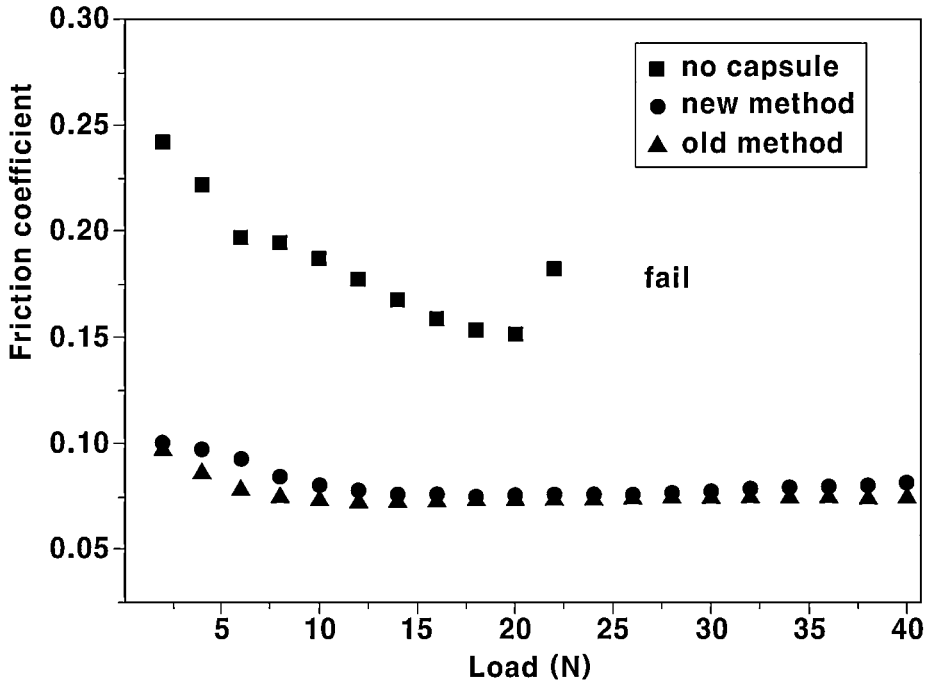
FIG. 7 is a result of Experimental Example 1.

The experimental results were as shown in FIG. 7.

As shown in FIG. 7, the coating material without the oilgel capsules had friction and subsequent severe seizure phenomenon so that it was not successful in the evaluation of a pressure of 25 N or higher. The present disclosure (manufacturing of oilgel capsules using an organic solvent emulsion) has proven to be an excellent low-friction material having a similar friction coefficient compared to the prior patent (manufacturing of oilgel capsules using O/W emulsion).

Experimental Example 2. Comparison of Daily Production

The daily productions of Example 1 and Comparative Example 1 manufactured as described above were compared.

In the Example, unlike the Comparative Example, because it does not require drying time of 1 week or more and redispersion process of 1 day or more, daily production can be dramatically improved, and specifically, less than 10 minutes of time is required to prepare 2 kg of an oilgel capsule solution, and this shows about 100 kg/day of production.

Figure 8:
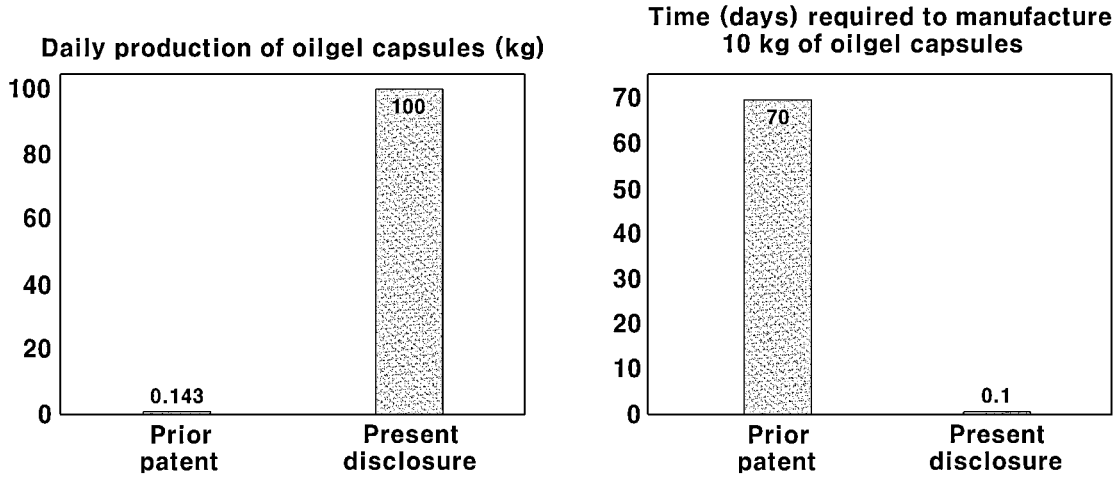
FIG. 8 is a result of Experimental Example 2.

The experimental results were as shown in FIG. 8.

As shown in FIG. 8, the daily production of the oilgel capsules in the present disclosure was 100 kg, and the daily production thereof in the prior patent was 0.143 kg. This means about 700 times improved productivity. Further, it was confirmed that the prior patent takes 70 days and the present disclosure takes 0.1 days in order to manufacture 10 kg of the oilgel capsules.

What is claimed is:

1. A method for preparing an emulsion composition comprising oilgel capsules, the method comprising:

mixing an oil and a gelator to produce an oilgel; and mixing the oilgel and an organic solvent containing a nonionic surfactant to produce at least one oilgel capsule having the oilgel encapsulated by the nonionic surfactant wherein the at least one oilgel capsule is dispersed in the organic solvent, wherein the organic solvent is not emulsified with the oil, wherein the organic solvent comprises dimethylacetamide, N-methyl-2-pyrrolidone, N-octyl pyrrolidone, N-phenyl pyrrolidone, dimethylformamide, dimethyl sulfoxide, methanol, ethanol, propanol, butanol, isopropanol, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, derivatives thereof, and combinations thereof, and wherein the oilgel and the organic solvent containing the nonionic surfactant are mixed at a weight ratio in a range of 1:1 to 1:10.

2. The method of claim 1, wherein the nonionic surfactant is a block copolymer having a hydrophilic portion and a hydrophobic portion together.

3. The method of claim 2, wherein the nonionic surfactant comprises PEO-PPO-PEO derivatives, PPO-PEO-PPO derivatives, PEO-PBO-PEO derivatives, or tetronic acid derivatives in a form of poly(alkylene-oxide) block copolymers, polyoxyethylene lauryl ether, polyoxyethylene trimethylnonyl ether, polyoxyethylene alkyl ether, polyoxyethylene fatty acid ester, polyoxyethylene alkylphenol ether, or polyoxyethylene sorbitan fatty acid ester in a form of alkyl PEO, sorbitan fatty acid ester in a form of fatty acid ester, or sucrose fatty acid ester.

4. The method of claim 1, wherein the gelator is mixed in an amount of 1 to 10 parts by weight with respect to 100 parts by weight of the oil.

5. The method of claim 4, wherein the oil comprises an engine oil, and wherein the gelator comprises 12-hydroxyoctadecanoic acid, ricinoleic acid, 1,3;2,4-dibenzylidene-D-sorbitol in a form of hydroxy fatty acids, N-dioctanoyl-l-lysine, N-didecanoyl-l-lysine, N-dilauroyl-l-lysine, N-dimyristoyl-l-lysine, 2-palmitamide hexanoic acid, or N-lauroyl-L-glutamic acid-α,γ-bis(n-butylamide) in a form of amino acids, or a mixture of ceramide and lecithin.

6. The method of claim 1, wherein the oilgel is in a liquid state.

7. The method of claim 1, wherein the oilgel capsules have a particle size in a range of 0.1 μm to 10 μm.

8. The method of claim 1, wherein the oil and the gelator are mixed using a grinder.

9. The method of claim 1, wherein the oilgel and the organic solvent are mixed using an ultrasonicator.

10. The method of claim 1, wherein the oilgel has a phase transition temperature in a range of 50° C. to 80° C.

11. An emulsion composition comprising:

oilgel capsules formed via mixing an oil and a gelator to provide an oilgel, and mixing the oilgel and an organic solvent containing a nonionic surfactant to provide the oilgel capsules having the oilgel encapsulated by the nonionic surfactant, wherein the oilgel capsules are dispersed in the organic solvent, wherein the organic solvent is not emulsified with the oil, wherein the organic solvent comprises dimethylacetamide, N-methyl-2-pyrrolidone, N-octyl pyrrolidone, N-phenyl pyrrolidone, dimethylformamide, dimethyl sulfoxide, methanol, ethanol, propanol, butanol, isopropanol, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, derivatives thereof, and combinations thereof, and wherein the oilgel and the organic solvent containing the nonionic surfactant are mixed at a weight ratio in a range of 1:1 to 1:10.

12. A method for preparing a coating composition for preventing wear of machine parts, the method comprising:

mixing an oil and a gelator to produce an oilgel;

mixing the oilgel and an organic solvent containing a nonionic surfactant to produce oilgel capsules having the oilgel encapsulated by the nonionic surfactant wherein the oilgel capsules are dispersed in the organic solvent;

preparing an emulsion composition comprising the oilgel capsules; and preparing the coating composition by mixing the emulsion composition and an overlay solution, wherein the overlay solution comprises a polymer, the organic solvent, and an additive, wherein the organic solvent is not emulsified with the oil, wherein the organic solvent comprises dimethylacetamide, N-methyl-2-pyrrolidone, N-octyl pyrrolidone, N-phenyl pyrrolidone, dimethylformamide, dimethyl sulfoxide, methanol, ethanol, propanol, butanol, isopropanol, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, derivatives thereof, and combinations thereof, and wherein the oilgel and the organic solvent containing the nonionic surfactant are mixed at a weight ratio in a range of 1:1 to 1:10.

13. The method of claim 12, wherein the emulsion composition is 5% to 25% by weight of a total weight of the coating composition.

14. The method of claim 12, wherein the coating composition is prepared while maintaining a temperature of 45° C. or less in the preparing of the coating composition.

15. The method of claim 12, wherein the polymer comprises polyamide-imide (PAI), polyimide, polybenzimidazole, polyepoxy, polyurethane, polyethylene oxide, or polyacetal, and wherein the additive comprises carbon black, polytetrafluoroethylene (PTFE), molybdenum disulfide (MoS2), or polyetheretherketone (PEEK).

16. The method of claim 12, wherein the coating composition has a friction coefficient of 0.15 or less.

17. The method of claim 1, wherein the organic solvent is dimethylacetamide, N-methyl-2-pyrrolidone, N-octyl pyrrolidone, N-phenyl pyrrolidone, dimethylformamide, dimethyl sulfoxide, trifluoroacetic acid, 1,1,2,2-tetrachlorethane, m-Cresol, 2-chlorophenol, butyrolactone, γ-butyrolactone, diglycolamine, tetrahydrofuran, methyl ethyl ketone, sulfolane, derivatives thereof, and combinations thereof.

* * * * *